United States Patent [19]

Harlin et al.

[11] Patent Number: 4,921,539

[45] Date of Patent: May 1, 1990

[54] MODIFIED PITCH SPECIALLY ADAPTED TO BIND COAL PARTICLES

[75] Inventors: Jean-Pierre Harlin, Rousen; Jean-Pierre Giorgetti, Montfort sur Risle; Bernard Ruquier, Petit-Couronne; Robert Herment, Montreuil, all of France

[73] Assignee: Shell Oil Company, Houston, Tex.

[21] Appl. No.: 256,526

[22] Filed: Oct. 12, 1988

[30] Foreign Application Priority Data

Oct. 30, 1987 [FR] France ..... 87 15071

[51] Int. Cl.[5] ..... C08L 95/00

[52] U.S. Cl. ..... 106/284.03; 106/284.3; 106/284.4; 106/284.06; 208/44; 525/545; 525/360

[58] Field of Search ..... 106/273.1, 284.3, 284.4, 106/284.03, 284.06; 208/44; 525/360, 54.5

[56] References Cited

U.S. PATENT DOCUMENTS

| | | | |
|---|---|---|---|
| 4,157,002 | 4/1979 | Fang | 106/123 |
| 4,332,704 | 6/1982 | Marzocchi | 523/204 |
| 4,337,193 | 1/1982 | Saita | 268/97.5 |
| 4,623,395 | 11/1986 | Goodrich | 106/273 |
| 4,629,754 | 12/1986 | Syrier et al. | 524/394 |

FOREIGN PATENT DOCUMENTS

| | | |
|---|---|---|
| 50-20052 | 5/1975 | Japan . |
| 50-51088 | 7/1975 | Japan . |
| 54-142204 | 6/1979 | Japan . |
| 58-29893 | 2/1983 | Japan . |
| 1114246 | 5/1968 | United Kingdom . |
| 1329411 | 9/1973 | United Kingdom . |
| 15727940 | 10/1973 | United Kingdom . |

*Primary Examiner*—Paul Lieberman
*Assistant Examiner*—Helene Klemanski
*Attorney, Agent, or Firm*—Ronald R. Reper

[57] ABSTRACT

The invention concerns a modified pitch composition specially adapted to bind coal particles with the purpose of transforming it into briquettes; the pitch is modified by reaction with an unsaturated dicarboxylic acid or anhydride thereof, and at least on crosslinking agents selected from hydroxide of a Group I metal, and certain polyamines, polyalcohols and alcoholamines.

7 Claims, No Drawings

MODIFIED PITCH SPECIALLY ADAPTED TO BIND COAL PARTICLES

BACKGROUND OF THE INVENTION

The invention concerns a pitch derivative used to bond small coal for the purpose of transforming it into briquettes. Such briquettes are known for example from the publication of French patent no. 2446857.

Generally, bitumens are used to agglomerate small coal which when compressed into pellets renders "raw briquettes". These raw briquettes generally then undergo thermal processing at about 350° C. in order to convert them into "smokeless briquettes."

The binder is required to agglomerate the pellets and to give them a certain mechanical resistance but not to the point that mixing at temperatures between approximately 80 and 95° C. becomes impossible. This factor explains why technicians prefer binders that have a softening point falling between 80 and 90° C. What is more, the pellets that are placed on a belt during the smokeless procedure must be resistant to crushing when they experience thermal shock as they are placed in the oven. With known binders the material obviously softens with the rise in temperature and the pellets' crush resistance correspondingly diminishes with the increase in temperature.

The goal of the invention, then, is to supply a binder which remains "discrete" up to approximately 95° C. and then becomes "active" at a temperature of 100° C. and remains so until the rigidity factor of carbonization takes over. It should be noted that this chemical activity must take place when the binder is dispersed in an inert medium, with coal representing approximately 90% of the mixture's mass.

A pitch derivative was described in British patent no. 1329411 which has a high softening threshold, prepared by the reaction of steam cracking tar (which contains from 30 to 50% steam cracking pitch) with an aldehyde and a third reagent, e.g., maleic anhydride. A crush resistance of between 100 and 125 daN was claimed for raw briquettes, though no details were given on their resistance at high temperatures. Furthermore, it is necessary to have the tar react with formaldehyde, along with phenol and concentrated sulfuric acid. This is inconvenient and rather expensive.

On the other hand we know from U.S. Pat. No. 4,337,193 of a composition based on tall oil pitch (from pine trees) that is modified by maleic anhydride and which contains a polyamine. However, this composition is not described as being used to bind small coal and it is impossible to deduce from this publication what the crush resistance factors are, all the more so at varying temperatures.

SUMMARY OF THE INVENTION

The invention provides a modified pitch composition specially adapted for binding coal particles comprising pitch derived from petroleum, coal or a mixture of pitch derived from petroleum and of pitch derived from coal, reacted with an unsaturated dicarboxylic acid or an anhydride thereof, and further reacted with at least one crosslinking agent selected from inorganic hydroxides of a Group I metal and organic compounds having from 2 to 10 carbon atoms selected from polyamines, polyalcohols and alcoholamines.

The invention further provides a method for preparation of a modified pitch composition specially adapted to bind coal particles with the purpose of transforming it into briquettes, which process comprises:

(a) reacting a petroleum and/or coal derived pitch having a softening point between about 30 and 80° C. with an unsaturated dicarboxylic acid or an anhydride thereof, and (b) reacting the product of step (a) with at least one crosslinking agent selected from inorganic hydroxides of a Group I metal, and organic compounds having 2 to 10 carbon atoms and selected from polyamines, polyalcohols and alcoholamines.

DESCRIPTION OF PROJECTED EMBODIMENTS

According to this invention the pitch is modified by anhydride groups from an unsaturated dicarboxylic acid and the adjunction of one or more crosslinking agents.

The pitch starting material is a solid or semisolid residue remaining after evaporation or distillation of more volatile components from tarry products derived from petroleum or coal. Typically these are wax-free residuums from vacuum or steam distillation of crude oils and coals, solvent extraction residuum and/or steam cracking residuum. The pitch starting material may be a mixture of pitches derived from different processes applied to petroleum or coal, or a mixture of pitches obtained from each of petroleum and coal.

Exemplary unsaturated dicarboxylic acids include maleic acid, itaconic acid, acetylene dicarboxylic acid and aconitic acid.

In the best of cases, the modified pitch also displays one or more of the following characteristics:

maleic acid is the unsaturated acid;

the pitch is made up of petroleum pitch (0 to 100%) and/or coal tar pitch (0 to 100%) and possibly of other pitches, in particular tall oil pitch.

the pitch contains at least 90% pitch; directed from a cracking, i.e., a molecular weight reduction process.

the unmodified pitch has a softening threshold falling between about 30 and 80° C. (ball and ring temperature per ASTM D36 method);

the crosslinking agent is chosen among inorganic hydroxides, (poly)amines, (poly)alcohols and alcoholamines;

at least one inorganic hydroxide and a second crosslinking agent, such a polyamine, a polyalcohol or an alcoholamine, are present;

the first or the only crosslinking agent is a hydroxide from an alkaline metal, preferably potassium;

the crosslinking agent is a ethylene (poly)amine having the following formula; $H_2NCH_2(CH_2NHCH_2)_nCH_2NH_2$, in which $0 \leqq n \leqq 4$, preferably $n=1$;

the modified pitch has a composition ratio of acid groups which corresponds to a reaction of 1 to 20 kg of dicarboxylic acid of anhydride with 100% kg of unmodified pitch.

the pitch also contains water in quantities of 50 to 150 kg per 100 kg of modified pitch.

The invention also concerns a process for the preparation of a pitch derivative which is used to bind small coal with the end of transforming it into briquettes, characterized by the fact that it includes (a) the reaction of pitch with an anhydride from an unsaturated dicarboxylic acid followed by (b) the adjunction of one or more crosslinking agents.

The word "adjunction" is used here because it is unknown whether or not a chemical reaction takes place with the crosslinking agent, and, should that be the case, whether the reaction occurs with the modified pitch or the coal.

The reaction (a) takes place at a temperature well above the pitch's softening threshold, and well below the acid's of anhydride's boiling point; for the most part between 100 and 250° C., and in particular between 150 and 200° C., and preferably about 180° C. The time lapse includes the introduction of the anhydride with stirring (for example between 0 and 1 hour, preferably a half hour), stirring (for example between 1 and 3 hours, preferably 1 hour) and a time for aging without stirring (for example between 0 and 2 hours). Step (b) can be carried out at the same temperature as that for step (a), but should the crosslinking agent(s) be added just before or during mixing with particulate coal (as is preferred) this temperature of course is that of the mixture, generally between 80 and 95%, when steam is used.

EXAMPLES

I - Condensation of the pitch and the maleic anhydride

The heat pre-liquified pitch is introduced into a closed glass reactor, and is equipped with a mechanical agitator, an immersion heater to control the temperature of reaction, a hooper to introduce the maleic anhydride and a cooling agent which allows aeration and the condensation of anhydride steam.

Example 1

A steam cracking pitch (800 g) is heated to 180° C. and maleic anhydride (88 g) is added, while stirring, in 30 minutes. The stirring is continued for a period of 2 ½ hours. The progress of the reaction is monitored by infrared absorption and by measurement of the BRT (ball and ring temperature).

Example 2

A steam cracking pitch (5,000 g) is heated to 180° C. and maleic anhydride (555 g) is added in 45 minutes. Aging lasts 3 hours at 180° C.

Example 3

A mixture of steam cracking pitch (400 g) and coal tar pitch (400 g) is heated to 180° C. and maleic anhydride (88 g) is added in 60 minutes. Stirring is continued for a period of 2 hours at 180° C.

Example 4

A coal tar pitch (634 g) is heated to 180° C. and maleic anhydride (70 g) is added in 60 minutes. Stirring is continued for a period of 30 minutes at 180° C.

Example 5

The maleinized pitch of example 4 (92 g) is mixed with a coal distillate (8 g) so as to lower the softening threshold.

Example 6

Example 1 is repeated using 140 g of anhydride instead of 88 g.

Example 7 (comparative)

A carbasphalte bitumen (a registered trademark of Shell Francaise), having a P25 value of 2 and a BRT of 85° C., and which is used to agglomerate small coal, is fluxed using a diluent in order to lower the BRT of the unmodified bitumen, such that the modified bitumen retains a BRT of approximately 85° C., and is then condensed with maleic anhydride according to the procedure of example 4.

Example 8 (comparative)

Example 7 is repeated using only 35 g of anhydride.

Table 1 shows the physical properties of the various pitches and other binders (given for purposes of comparison) before and after maleinization.

Legend:

BRT = Ball and Ring Temperature, in other words the softening threshold (° C.), as determined by the ASTM D36 method.

P25 Penetration at 25° C. (0.1 mm), in other words viscosity as determined by the ASTM D5 method.

P35 = Penetration at 35° C. (0.1 mm).

TABLE 1

| BINDER | Before Maleinization | | | After Maleinization | | |
|---|---|---|---|---|---|---|
| (% of Maleinization) | BRT | P25 | P35 | BRT | P25 | P35 |
| Example 1 (10%) | 39.5 | 138 | | 63 | 10 | |
| Example 2 (10%) | 56 | 21 | | 77 | | |
| Example 3 (10%) | 62 | | | 78 | | |
| Example 4 (10%) | 70 | | | 104 | | |
| Example 5 (10%) | 70 | | | 88 | | |
| Example 6 (15%) | 39.5 | 138 | | 56 | 18 | |
| Example 7 (10%) | 72.5 | | 25.5 | 81 | | |
| Example 8 ( 5%) | 72.5 | | 25.5 | 88 | | 19 |

Example 9

A mixture of 84% coal tar pitch and 16% coal distillate is maleinized according to the procedure of example 4.

II - Adjunction of Crosslinking Agents and Mixing

The binder maleinized according to the above examples is added to small coal in the desired proportions (generally between 7 and 9% by weight of 100% coal), and the mixture is mixed in mixer with saturated steam at a temperature of approximately 95° C. Several minutes before mixing and/or during mixing, the desired quantity of potassium hydroxide is added (as a 50% proof liquor) and/or the desired quantity of diethylenetriamine. Mixing continues for a period of approximately 3 to 10 minutes until a homogeneous paste is obtained.

III - Determination of Crush Resistance

The coal, water and binder (modified) mixture is compressed into the shape of small cylinders 40 mm in diameter and 25 mm in height. These cylinders are conditioned in a stove and crushed, two at a time, at varying temperatures. Even though these cylinders do not match industrial conditions, the test method is homogeneous and makes comparison possible.

Table 2 shows results obtained using binders in keeping and not in keeping with the invention. Water content at the ambient temperature is also given. Remark. Unless otherwise stated, the binders in keeping with examples 1 through 9 are maleinized. DEA = diethylenetriamine (Nota Bene: in composition D, the DEA is introduced into the coal before the pitch, and after the pitch in composition E).

It should be noted that compositions J and P through X were included for purposes of comparison.

The table shows, for example, that crush resistance at 150° C. improves when going from composition C (DEA without water) to composition F (DEA 4% KOH, water) and passing through the intermediate compositions (D,G,E,A,B).

It also shows that bitumen based compositions (P,U-X) are not suitable.

TABLE 2

| Temperature at the center of the briquette | Crush Resistance (daN) | | | | | |
|---|---|---|---|---|---|---|
| BINDER + CROSSLINKING AGENT (% of coal) | 20 | 105 | 150 | 200 | 250 | 270 |
| A = Example 1 (7%) + KOH(2%) + 10 water | 162 | 54 | 33 | 22 | 18 | 17.5 |
| B = Example 1 (7%) + KOH(4%) + 10 water | 108 | 51 | 35 | 24 | 20 | 19 |
| C = Example 1 (7%) + DEA(4%) | 220 | 72 | 12 | 8 | 18 | 21 |
| D = Example 1 (7%) + DEA(1.8%) + 8% water | 200 | 51 | 15 | 8 | 20 | 29 |
| E = Example 1 (7%) + DEA(1.8%) + 8% water | 206 | 58 | 19 | 9 | 22 | 32 |
| F = Example 1 (7%) + DEA(1.8%) + KOH(4%) + 6% water | 154 | 68 | 36 | 25 | 20 | 25 |
| G = Example 1 (7%) + DEA(1.8%) + KOH(1%) + 8% water | | | | | | |
| H = Example 3 (7%) + KOH(4%) + 8% water | 126 | 39 | 24 | 19 | 16 | 18 |
| I = Example 3 (7%) + DEA(1.8) + 8% water | 160 | 43 | 18 | 11 | 17 | 29 |
| J = Example 3 (7%) + $Ca(OH)_2$(2%) + 10% water | 80 | 6 | 3 | 2 | 4 | 10 |
| K = Example 3 (7%) + KOH(4%) + DEA(1.8%) + 6% water | 172 | 78 | 44 | 20 | 14 | 18 |
| L = Example 6 (7%) + DEA(1.8%) + 8% water | 180 | 68 | 23 | 12 | 30 | 44 |
| M = Example 6 (7%) + DEA(1.8%) KOH(4%) + 6% water | 146 | 68 | 44 | 27 | 16 | 23 |
| N = Example 9 (7%) + DEA(1.8%) + 8% water | 100 | 50 | 20 | 9 | 13 | 21 |
| O = Example 9 (7%) + KOH(4%) + 8% water | 60 | 40 | 24 | 16 | 14 | 12.5 |
| P = Example 7/8 unmodified (7%) + 10% water | 146 | 1.4 | 1.0 | 0.7 | 1.5 | 20.5 |
| Q = Example 1 unmodified (7%) | 112 | 5.2 | 2.6 | 2.2 | 3.9 | 11.8 |
| R = Example 4 unmodified (9%) | 156 | 1.9 | 1.4 | 1.4 | 3.6 | 12.4 |
| S = Q + KOH(4%) 10% water | 130 | 20 | 10 | 7 | 15 | 20 |
| T = Example 1 (7%) + 10% water | 138 | 8 | 4.6 | 3 | 9.5 | 18 |
| U = P + DEA(5%) | 190 | 20 | 2 | 1 | 3 | 9 |
| V = Example 8 (7%) | 84 | 2.3 | 1.1 | 1.0 | 1.3 | 5.7 |
| W = Example 8 (7%) + DEA(6%) | 197 | 30 | 4.7 | 3.6 | 3.7 | 3.7 |
| X = Example 8 (7%) + KOH(0.4%) + 10% water | 70 | 3.3 | 1.9 | 1.4 | 2.2 | 3.8 |

What is claimed is:

1. A modified pitch composition specially adapted for binding coal particles comprising pitch derived from petroleum and having a softening point falling between 30 and 80? C., which pitch is reacted at a temperature from 150 to 200° C. with maleic anhydride to obtain a reacted pitch having a percentage of maleic anhydride groups corresponding to a reaction of 1 to 20 Kg of maleic anhydride with 100 Kg of pitch, and is further reacted with both a crosslinking agent selected from inorganic hydroxides of a Group I metal and a second crosslinking agent selected from polyamines having from 2 to 10 carbon atoms wherein the weight ratio of reacted pitch to crosslinking agents is in the range from about 1:1 to 10:1.

2. Composition according to claim 1 containing in addition water in quantities from about 50 to 150 kg per 100 kg or further reacted pitch.

3. Composition according to claim 1 wherein said Group I metal hydroxide is selected from sodium and potassium.

4. Composition according to claim 1 wherein said polyamine second crosslinking agent is an ethylene (poly)amine represented by the formula: $H_2NCH_2(CH_2NCH_2)_nCH_2NH_2$ in which $0 \leqq n \leqq 4$.

5. Composition according to claim 4 wherein $n=1$.

6. A method for the preparation of a modified pitch composition specially adapted to bind coal particles with the purpose of transforming said particles into briquettes, which process comprises:

(a) reacting at a temperature from about 150 to 200° C. a petroleum pitch having a softening point between about 30 and 80° C. with an unsaturated dicarboxylic acid or an anhydride thereof to obtain a reacted pitch, (b) mixing coal particles into said reacted pitch, either prior to or during step (c), and (c) reacting the product of step (a) or step (b) with a first crosslinking agent selected from inorganic hydroxides of Group I metals and a second crosslinking agent selected from polyamines of from 2 to 10 carbon atoms wherein the weight ratio of reacted pitch to crosslinking agents is in the range from about 1:1 to 10:1.

7. The product of the process of claim 6.

* * * * *